United States Patent [19]

Clark

[11] 4,285,543

[45] Aug. 25, 1981

[54] ROCKER ATTACHMENT

[76] Inventor: Chester V. Clark, P.O. Box 644, Yarnell, Ariz. 85362

[21] Appl. No.: 103,994

[22] Filed: Dec. 17, 1979

[51] Int. Cl.[3] ..... A47D 13/10

[52] U.S. Cl. ..... 297/272; 297/33; 297/133

[58] Field of Search ..... 297/272, 133, 33

[56] References Cited

U.S. PATENT DOCUMENTS

| | | | |
|---|---|---|---|
| 875,903 | 1/1908 | Flemming | 297/133 X |
| 2,662,581 | 12/1953 | Gottfried | 297/133 |
| 3,114,572 | 12/1963 | Hopkins | 297/133 X |

FOREIGN PATENT DOCUMENTS

| | | | |
|---|---|---|---|
| 203171 | 5/1959 | Austria | 297/33 |
| 870938 | 5/1971 | Canada | 297/133 |
| 2014314 | 10/1971 | Fed. Rep. of Germany | 297/272 |

*Primary Examiner*—James T. McCall

*Attorney, Agent, or Firm*—Herbert E. Haynes, Jr.

[57] ABSTRACT

Rocker attachments for converting a stationary folding lawn chair into a rocking chair including a spaced pair of arcuate tubular rocking elements which are transversely interconnected by beam structures which are demountably attachable to the chair. The beam structures are demountably connected to the rocker elements for storage and shipping purposes and are movable on the rocker elements to accommodate various sizes of lawn chairs.

9 Claims, 8 Drawing Figures

ROCKER ATTACHMENT

BACKGROUND OF THE INVENTION

1. Field of the Invention

This invention relates to rocker assemblies for attachment to stationary chairs and more particularly to a simple low-cost rocker assembly for use on folding chairs of the type commonly referred to as "lawn chairs".

2. Description of the Prior Art

Many attempts have been made over the years to develop a simple low-cost rocker assembly for converting a stationary chair into a rocker. Early developments in this art are exemplified by U.S. Pat. No. 1,231,151 issued to W. H. Gerrard, Jr. on June 26, 1917, and U.S. Pat. No. 1,295,382 issued on Feb. 25, 1919 to M. J. Stelzer. In these two prior art patents, the bottom ends of four depending legs of conventional chairs are received in especially configured socket-like fixtures that are carried on a spaced pair of arcuately shaped rockers.

U.S. Pat. No. 2,662,581 issued to L. Gottfried on Dec. 15, 1953 shows several rocker attachment configurations for use on various types of chairs. Of particular interest is the embodiment which is adapted to attach to a folding lawn chair of the type having U-shaped front and rear ground engaging members. The rocker attachment includes a spaced pair of arcuate rockers which are interconnected by a pair of spaced U-shaped in cross section channel members fixedly carried on the top of the rockers. The channel members are laid on their sides so as to be open on the sides which face each other. The bottom segments of the chair's ground engaging members are inserted into the channels of the rocker attachment during unfolding of the chairs, and are secured therein by spring bolts.

U.S. Pat. No. 4,079,991 issued on Mar. 21, 1978 to Harris discloses an especially configured pair of arcuate rocker devices which may be attached to either conventional chairs or to those referred to as folding lawn chairs. In the case of the lawn chairs, the U-shaped ground engaging members may either be tied to the arcuate rockers or may be snapped into special grooves formed transversely in the rockers.

In general, all the above discussed prior art devices are relatively complex and expensive to fabricate and this alone has contributed significantly to the lack of widespread commercial acceptance. More specifically, the structure disclosed in the Gottfried Patent cannot be adapted for use on different size chairs due to the fixed attachment of the channels on the rockers, and also attachment of the lawn chair can be an awkward task. The Harris Patent requires that the special rockers be fabricated of flexible and compressible materials such as plastic, and the cost of fabricating such special rockers is prohibitive in all but extremely high production.

Therefore, a need exists for a new and improved rocker attachment for converting a stationary folding lawn chair into a rocker, with this attachment being simple to use, inexpensive to manufacture, and otherwise overcoming some of the drawbacks and shortcomings of the prior art.

SUMMARY OF THE INVENTION

In accordance with the present invention, new and improved rocker attachments of various configurations are disclosed for converting a stationary folding lawn chair into a rocking chair. Each embodiment of the present invention includes a pair of tubular rocker elements which are bowed into the desired arcuate configuration and are interconnected by a pair of transverse beam means which are adapted to demountably receive the ground engaging segments of the folding lawn chair. The beam means are movably mounted on the tubular rockers so as to be adjustably spaced to accommodate various sizes of chairs.

In a first embodiment, the beam means includes structural angle members which transversely interconnect and are slidably mounted on the tubular rockers and have upwardly opening spring clips for demountable connection to the transverse bars of the U-shaped ground engaging members of the folding lawn chair.

In a second embodiment, the beam means includes U-shaped in cross sectional channel members which transversely interconnect the tubular rockers. The channel members are disposed so as to open upwardly for demountably receiving the transverse bars of the U-shaped ground engaging members of the folding lawn chair, and the channels are demountable and adjustably connected to the tubular rockers by spring clips.

In a third embodiment, the beam means includes the same upwardly opening U-shaped channels for demountably receiving the transverse bars of the folding chair, and the channels are demountably and slidably connected to the tubular rockers by depending tabs having apertures formed therethrough. Once the proper spacing of the channels has been determined for a particular chair size, the channels can be fixed on the tubular rockers such as by screw fasteners.

The various embodiments briefly discussed above are inexpensive to manufacture in that all of the materials used are commercially available items which eliminates all special moldings, castings, fabrication and the like as required by prior art structures. These rocker attachments are adaptable for use on any size of folding lawn chair due to the adjustable mounting of the beam means and the rocker attachments are of the knock-down type for convenient shipping and storage due to the demountable connection of the beam means on the tubular rocker elements. Further, the rocker attachments of the present invention are simple to use in that once adjusted for the proper size, all that is required is for the chair to be placed atop the rocker attachment so that the transverse bar segments of the chair are in engagement with the beam means.

Accordingly, it is an object of the present invention to provide new and improved rocker attachments for converting a folding lawn chair into a rocking chair.

Another object of the present invention is to provide new and improved rocker attachments for converting a folding lawn chair into a rocking chair with the rocker attachment being inexpensive to manufacture and simple to use.

Another object of the present invention is to provide new and improved rocker attachments which are adjustable for use in converting variously sized folding lawn chairs into rocking chairs.

Another object of the present invention is to provide new and improved rocker attachments of the above described type which include a pair of tubular rocker elements of arcuate configuration.

Another object of the present invention is to provide new and improved rocker attachments of the above described character in which the tubular rocker elements are demountably interconnectable by a pair of beam means which are adapted to demountably receive the transverse bar portions of the folding lawn chair, with the beam means being adjustably movable to adapt to chairs of various sizes.

Another object of the present invention is to provide new and improved rocker attachments of the above described character in which the beam means comprises a pair of angle members demountable and slidably movable on the tubular rockers and having spring clips for attachment to the lawn chair.

Still another object of the present invention is to provide new and improved rocker attachments of the above described type in which the beam means comprises a pair of U-shaped in cross section channels which are demountably adjustably connected to the tubular rocker element by spring clips and which are disposed to open upwardly to demountably receive the transverse bars of the folding lawn chair.

Yet another object of the present invention is to provide new and improved rocker attachments of the above described character in which the beam means comprises a pair of U-shaped in cross section channels which are demountable and slidably movable on the tubular rocker elements by depending apertured tabs and are oriented so as to open upwardly for demountably receiving the transverse bar segments of the folding lawn chair.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
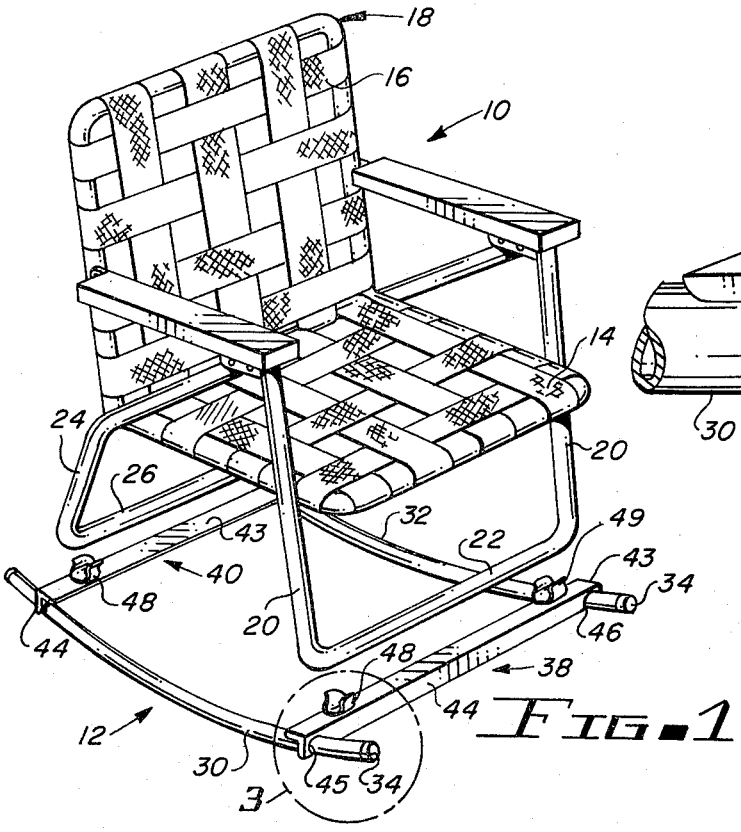
FIG. 1 is a perspective view of a folding lawn chair having the first embodiment of the rocker attachment of the present invention illustrated in exploded relationship therewith.
Figure 3:
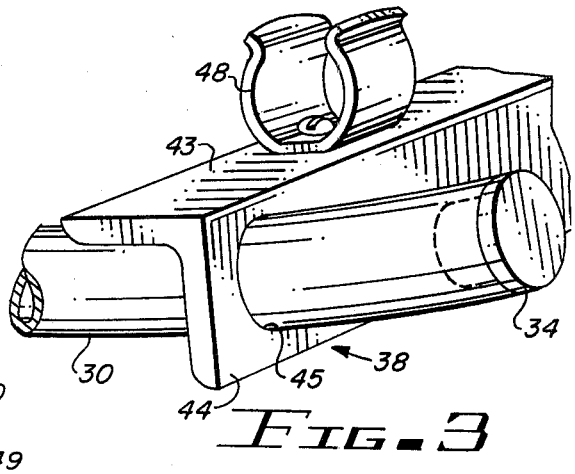
FIG. 3 is an enlarged fragmentary perspective view of that portion of the rocker attachment which is indicated in the dashed line circle identified as 3 in FIG. 1.
Figure 2:
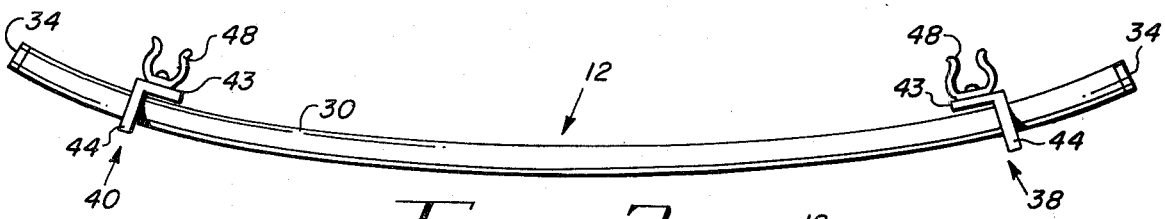
FIG. 2 is an enlarged side elevational view of the rocker attachment of the embodiment shown in FIG. 1.
Figure 4:
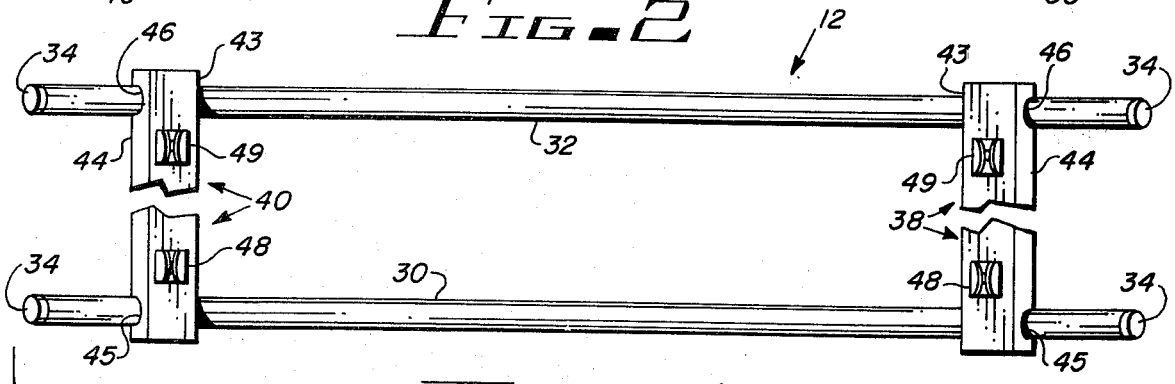
FIG. 4 is a fragmentary plan view of the rocker attachment of the embodiment shown in FIG. 1.

Referring more particularly to the drawings, FIG. 1 illustrates a typical type of folding chair of the type commonly referred to as a folding lawn chair, with the chair being indicated generally by the reference numeral 10. In FIG. 1, the folding lawn chair 10 is shown in exploded relationship with respect to a first embodiment of the rocker attachment of the present invention, with this configuration of the rocker attachment being indicated in its entirety by the reference numeral 12.

As shown, the folding lawn chair 10 includes the usual seat portion 14, back rest 16 and foldable tubular frame structure 18. The frame 18 includes front legs 20 having the depending ends thereof interconnected by an integral transverse bar 22, and the rear legs 24 (one shown) which are similarly interconnected by a transverse bar 26.

The rocker attachment 12, as shown in FIGS. 1–4, includes a pair of rocker elements 30 and 32 which are elongated hollow tubular members of circular cross section that are bent or bowed along their lengths into the desired arcuate configuration. The opposite ends of each of the rocker elements 30 and 32 are closed by suitable plugs 34. The tubular rocker members 30 and 32 are in spaced parallel relationship with respect to each other and are transversely interconnected adjacent their aligned front ends by a front beam means 38, and are similarly interconnected adjacent their aligned rear ends by an identical rear beam means 40.

Since the front and rear beam means 38 and 40 are identical, it will be understood that the following description of the front beam means 38 also applies to the rear beam means 40.

The front beam means 38 includes an elongated angle beam of right angle cross section which defines an elongated upper flange or leg 43 and a depending flange or leg 44. The depending leg 44 has a pair of apertures 45 and 46 formed therethrough with each aperture formed adjacent a different opposite end thereof. The front end of the rocker element 30 passes through the aperture 45 of the depending leg 44 and the front end of the rocker element 32 passes through the other aperture 46 thereof. The apertures 45 and 46 formed through the depending leg 44 are sized to frictionally grip the rocker elements 30 and 32 and yet allow the rockers to be slidably mounted therein for reasons which will hereinafter be described in detail. The upper flange or leg 43 has fastener means in the form of a pair of spring clips 48 and 49 mounted on the upwardly facing surface thereof and disposed so as to open upwardly. The spring clip 48 is fixedly mounted adjacent one end of the upper leg 43 and the spring clip 49 is similarly mounted adjacent the opposite end of the upper leg.

The hereinbefore described slidably movable feature of the beam means 38 and 40 on the rocker members 30 and 32 allows the rocker attachment 12 to be disassembled for shipping and storage purposes and also allows the spacing between the beam means to be varied so that the rocker attachment 12 may be employed with folding lawn chairs having various dimensions between the front and rear legs thereof.

With the rocker attachment 12 assembled and adjusted to match the spacing between the transverse bars 22 and 26 of the folding lawn chair 10, the chair is demountably mounted on the rocker attachment by simply snapping the front transverse bar 22 into the spring clips 48 and 49 of the front beam means 38 and similarly snapping the chair's rear transverse bar 26 into the spring clips 48 and 49 of the rear beam means 40.

Figure 5:
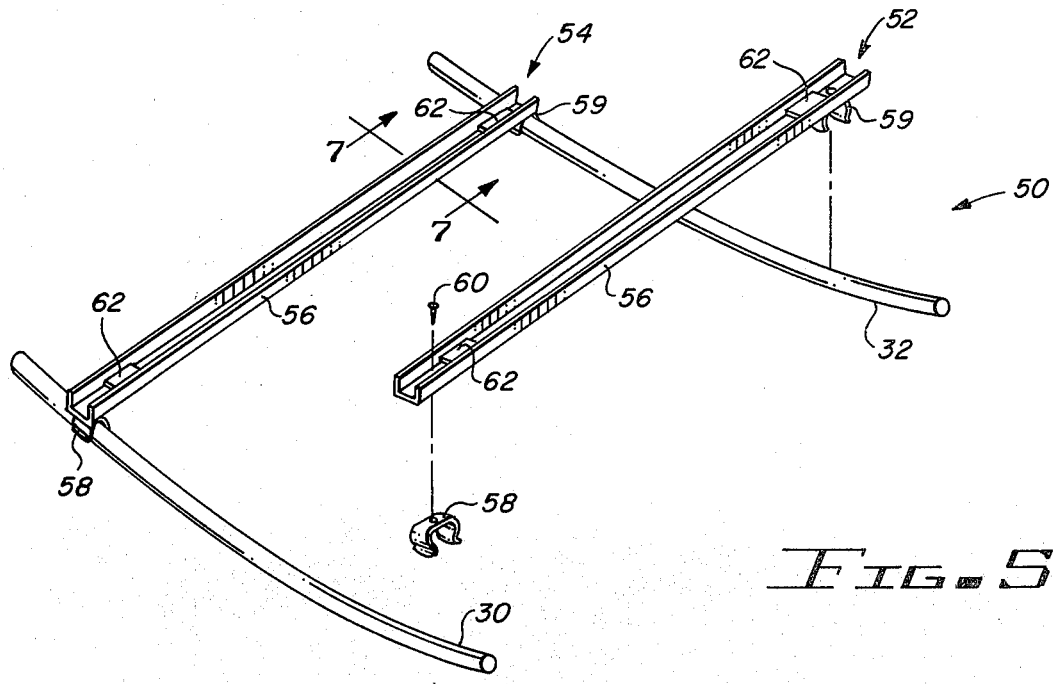
FIG. 5 is a perspective view of a second embodiment of the rocker attachment of the present invention with portions thereof being shown in exploded relationship to illustrate the various features thereof.
Figure 6:
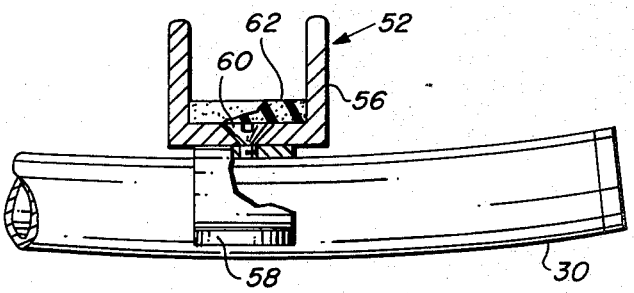
FIG. 6 is an enlarged fragmentary side elevational view of the structure shown in FIG. 5 and which is partially broken away to illustrate the various features thereof.

Referring now to FIGS. 5 and 6 wherein a second embodiment of the rocker attachment of the present invention is shown, with this second embodiment being indicated in its entirety by the reference numeral 50. The rocker attachment 50 includes the hereinbefore described pair of tubular rocker elements 30 and 32 and an identical pair of beam means 52 and 54.

Since the beam means 52 and 54 of the rocker attachment 50 are identical, the following description of the beam means 52 will be known to also apply to the other beam means 54.

The beam means 52 includes an elongated channel beam 56 of U-shaped cross section which is disposed to open upwardly. A pair of fastener means in the preferred form of spring clips 58 and 59 are affixed, such as by screws 60, so as to depend from the bottom surface of the channel beam 56. The spring clips 58 and 59 are each positioned adjacent a different opposite end of the channel beam 56 and are disposed to open downwardly.

The beam means 52 and 54 are transversely and demountably mounted on the rocker elements 30 and 32 by simply snapping the aligned ends of the rocker members 30 and 32 into the spring clips 58 and 59 of the beam means 52 and similarly connecting the opposite ends of the rocker elements into the spring clips 58 and 59 of the beam means 54. This type of assembly, of course, allows the rocker attachment 50 to be disassembled for shipment and storage purposes, and allows the spacing between the beam means 52 and 54 to be adjusted to accommodate variously sized folding lawn chairs as hereinbefore described.

The folding lawn chair 10 (FIG. 1) is demountably carried on the rocker attachment 50 by nestingly placing the transverse bars 22 and 26 of the chair in the channel beams 56 of the beam means 52 and 54. Suitable friction pads 62 such as of foam rubber are fixedly mounted in the channel beams 56 to prevent lateral slippage of the chair 10 relative to the rocker attachment 50.

Figure 7:
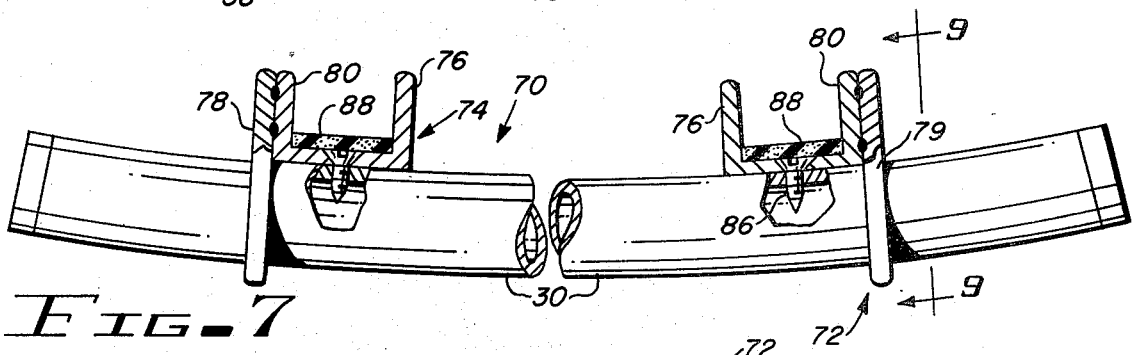
FIG. 7 is a fragmentary side elevational view of a third embodiment of the rocker attachment of the present invention with portions thereof broken away to show the various features.
Figure 8:
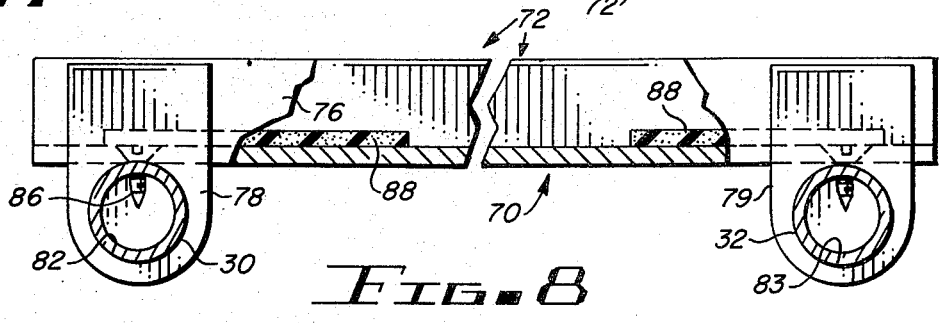
FIG. 8 is a fragmentary sectional view taken along the line 8—8 of FIG. 7.

Referring now to FIGS. 7 and 8 wherein a third embodiment of the rocker attachment of the present invention is illustrated, with this third embodiment being indicated generally by the reference numeral 70. The rocker attachment 70 includes the hereinbefore described pair of tubular rocker elements 30 and 32 and an identical pair of beam means 72 and 74.

In that the beam means 72 and 74 are identical, it will be understood that the following description of the beam means 72 also applies to the other beam means 74.

The beam means 72 includes an elongated channel beam 76 of U-shaped cross section which is disposed to open upwardly. A pair of tabs 78 and 79 are affixed, such as by welding, to one of the upstanding legs 80 of the channel beam 76 and are oriented thereon so that the lowermost portions of the tabs depend below the bottom of the channel. The tabs 78 and 79 are each positioned adjacent a different opposite end of the channel beam 76 and the depending lower ends of the tabs have apertures 82 and 83 respectively, formed therethrough.

The beam means 72 and 74 transversely interconnect and are demountably mounted on the rocker elements 30 and 32 by slidingly inserting aligned ends of the rocker elements 30 and 32 through the apertured tabs 78 and 79 of the beam means 72, and similarly inserting the aligned opposite ends of the rocker elements in the apertured tabs 78 and 79 of the other beam means 74. The apertures 82 and 83 of the tabs 78 and 79 are sized to allow sliding movement of the beam means 72 and 74 on the rocker elements 30 and 32 for disassembly and adjustment purposes as hereinbefore described. The apertures 82 and 83 may be sized to frictionally grip the rocker elements 30 and 32 in the manner described in regard to the rocker attachment 12. Alternately, the apertures 82 and 83 may be a relatively loose fit with the beam means being secured in the desired locations by sheet metal screws 86 after the proper spacing has been determined.

As was the case in the previously described rocker attachment 50, the folding lawn chair 10 (FIG. 1) is demountably supported on the rocker attachment 70 by nestingly placing the transverse bars 22 and 26 of the chair in the upwardly opening channel beams 76 of the beam means 72 and 74. Suitable friction pads 88, such as of foam rubber, are fixedly mounted within the channel beams 56 to prevent lateral slippage of the chair relative to the rocker attachment 70.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A rocker attachment for mounting on a folding lawn chair of the type having a pair of front legs integrally interconnected at the bottom ends by a first transverse bar and a second pair of legs integrally interconnected at the bottom ends by a second transverse bar, said rocker attachment comprising:

(a) a pair of rocker elements in spaced apart parallel relationship, each of said rocker elements formed of an elongated tubular member which is bowed along its length into an arcuate configuration;

(b) a spaced apart pair of beam means transversely interconnecting said pair of rocker elements for demountably receiving the first and second transverse bars of the folding lawn chair; and (c) said pair of beams are movably mounted on said pair of rocker elements for varying the spaced relationship of said pair of beam means.

2. A rocker attachment as claimed in claim 1 wherein said pair of beam means are demountably connected to said pair of rocking elements.

3. A rocker attachment as claimed in claim 1 wherein each of said pair of beam means comprises:

(a) an angle member having a first upwardly facing leg and a second leg depending normally therefrom, the second leg having a pair of apertures formed therethrough with each aperture formed adjacent a different one of the opposite ends thereof and each having a different one of said pair of rocker elements extending therethrough; and (b) fastener means mounted on the upwardly facing surface of the first leg of said angle member for demountably receiving one of the transverse bars of the folding lawn chair.

4. A rocker attachment as claimed in claim 3 wherein the apertures formed in the second leg of said angle member are sized to frictionally and slidably grip said pair of rocker elements.

5. A rocker attachment as claimed in claim 3 wherein said fastener means comprises a spaced apart pair of upwardly opening spring clips.

6. A rocker attachment as claimed in claim 1 wherein each of said pair of beam means comprises:

(a) a channel beam of U-shaped cross section which is disposed to open upwardly for nestingly receiving one of the transverse bars of the folding lawn chair; and (b) fastener means dependingly mounted on said channel beam for demountable and movable attachment to said pair of rocker elements.

7. A rocker attachment as claimed in claim 6 wherein said fastener means comprises a spaced apart pair of upwardly opening spring clips.

8. A rocker attachment as claimed in claim 6 wherein said fastener means comprises a spaced apart pair of tabs mounted on one of the upstanding legs of said channel beam, said pair of tabs each having its lower end depending below said channel beam and each having an aperture formed through its lower end through which one of said pair of rocker elements extends.

9. A rocker attachment as claimed in claim 6 and further comprising at least one friction pad mounted in said channel beam for frictionally engaging the one of the transverse bars of the lawn chair upon nestable placement thereof within said channel beam to prevent lateral slippage thereof.

* * * * *